US005820346A

United States Patent [19]

Young et al.

[11] Patent Number: 5,820,346

[45] Date of Patent: Oct. 13, 1998

[54] BLADE DAMPER FOR A TURBINE ENGINE

[75] Inventors: Kurt E. Young; Robert B. Dickman, both of Cincinnati; Jan C. Schilling, Middletown; Terry E. Buerkle, Cincinnati, all of Ohio

[73] Assignee: General Electric Company, Cincinnati, Ohio

[21] Appl. No.: 767,931

[22] Filed: Dec. 17, 1996

[51] Int. Cl.[6] ..... F01D 5/10

[52] U.S. Cl. ..... 416/193 A; 416/248; 416/500

[58] Field of Search ..... 416/145, 190, 416/193 A, 248, 500

[56] References Cited

U.S. PATENT DOCUMENTS

| | | | |
|---|---|---|---|
| 3,181,835 | 5/1965 | Davis | 416/145 |
| 4,218,188 | 8/1980 | Säterdal | 416/172 |
| 4,723,889 | 2/1988 | Charreron et al. | 416/193 A |
| 4,872,812 | 10/1989 | Hendley et al. | 416/193 A |
| 4,917,574 | 4/1990 | Dodd et al. | 416/190 |
| 5,205,713 | 4/1993 | Szpunar et al. | 416/193 A |
| 5,226,784 | 7/1993 | Mueller et al. | 416/248 |

*Primary Examiner*—Christopher Verdier

*Attorney, Agent, or Firm*—Andrew C. Hess; Patrick R. Scanlon

[57] ABSTRACT

A damper which provides both blade to blade and blade to ground damping is described. In one embodiment, the damper includes a retainer and a chicklet. The retainer is secured to a rotor disk by a bolt which extends through an opening in the disk and an opening in the retainer. The retainer includes support flanges which facilitate positioning retainer relative to the disk, and sidewalls (or guides) for limiting movement of the chicklet. The chicklet is movably positioned within the retainer, and movement of the chicklet is limited by sidewalls and a cross wall member of the retainer. The retainer positions the chicklet so that in operation, a contact surface of chicklet makes blade to blade contact with adjacent blades. In operation, centrifugal forces drive the chicklet into contact with the blade platforms. Since the chicklet is in contact with adjacent blades, blade to blade damping is provided. Further, due to the geometric configuration of the contact surfaces of the chicklet, the chicklet tends to travel upward along the underside of the platform. As the chicklet slides upward and rearward on the platform, the chicklet contacts the cross wall member of the retainer, and since the retainer is secured to the disk, blade to ground damping is provided by the damper.

13 Claims, 4 Drawing Sheets

BLADE DAMPER FOR A TURBINE ENGINE

GOVERNMENT RIGHTS

The government has rights in this invention pursuant to Contract No. F33657-94-C-0028 awarded by the Department of the Air Force.

FIELD OF THE INVENTION

This invention relates generally to turbines and more particularly, to damping vibratory energy in the blades of such turbines.

BACKGROUND OF THE INVENTION

Turbomachinery commonly employs blades, connected to a disk. For example, a typical compressor rotor assembly of a gas turbine engine includes a plurality of rotor blades extending radially outward across an airflow path. The blades generally include an airfoil section mounted radially outward of a blade root section. A platform is located between the airfoil section and the blade root section, and the platform forms a portion of the boundary between the rotor and the working medium. The blade is normally mounted in the rim of a rotor disk by its root interlockingly engaging a slot in the rim. Compressor blade roots are conventionally curvilinear in form and referred to as dovetail roots and the matching conforming slots are referred to as dovetail slots. Formed between the slots are posts in the rim of the disk which may have a radially outer surface forming another portion of the flowpath boundary.

The environment at high rotational rotor speeds induces vibratory stresses in the rotors and blades which cause high cycle fatigue and potential failure of the blade and post. Particularly, the blades may resonate with respect to each other or with respect to the disk. Such resonance may cause failures.

High cycle fatigue life of rotor blades has been extended by utilizing dampers to reduce the vibratory stresses occasioned by the high rotational speeds. Specifically, blade dampers may be located in the space between blades at the blade root to disk attachment sections. Most damper assemblies provide blade to blade damping generally between circumferentially adjacent blades. Some damper assemblies provide blade to ground damping. No known damper provides both blade to blade and blade to ground damping.

It would be desirable to provide improved damping of vibrations between blades and the structures to which the blades are attached. It also would be desirable to provide such improved damping at a reasonable cost.

SUMMARY OF THE INVENTION

These and other objects may be attained by a damper which provides both blade to blade and blade to ground damping. More particularly, and in one embodiment, the damper includes a retainer and a chicklet. The retainer is secured to a rotor disk by a bolt which extends through an opening in the disk and an opening in the retainer. The retainer includes support flanges which facilitate positioning the retainer relative to the disk, and sidewalls (or guides) for positioning the chicklet.

The chicklet is movably positioned within the retainer, and movement of the chicklet is limited by sidewalls and a cross wall member of the retainer. The retainer positions the chicklet so that in operation, a contact surface of chicklet makes blade to blade contact with adjacent blades. More specifically, in operation, centrifugal forces drive the chicklet into contact with the blade platforms. Since the chicklet is in contact with adjacent blades, blade to blade damping is provided. Further, due to the geometric configuration of the contact surfaces of the chicklet, the chicklet tends to travel upward along the underside of the platform. As the chicklet slides upward on the platform, the chicklet contacts the cross wall member of the retainer, and since the retainer is secured to the disk, blade to ground damping is provided by the damper.

As described above, both blade to blade and blade to ground damping is provided by damper, and such combination damping is believed to provide significantly greater than the damping provided by either blade to blade dampers or blade to ground dampers. Further, since the present damper provides both blade to blade and blade to ground damping, the damper can be used in a wider variety of applications than known dampers which provide only either blade to blade or blade to ground damping. That is, by providing multiple types of damping, rather than having to use multiple types of dampers for multiple applications, the present damper can be used for multiple applications, which is important because it facilitates reducing inventory costs and simplifies fabrication processes and controls.

DETAILED DESCRIPTION OF THE DRAWINGS

Figure 1:
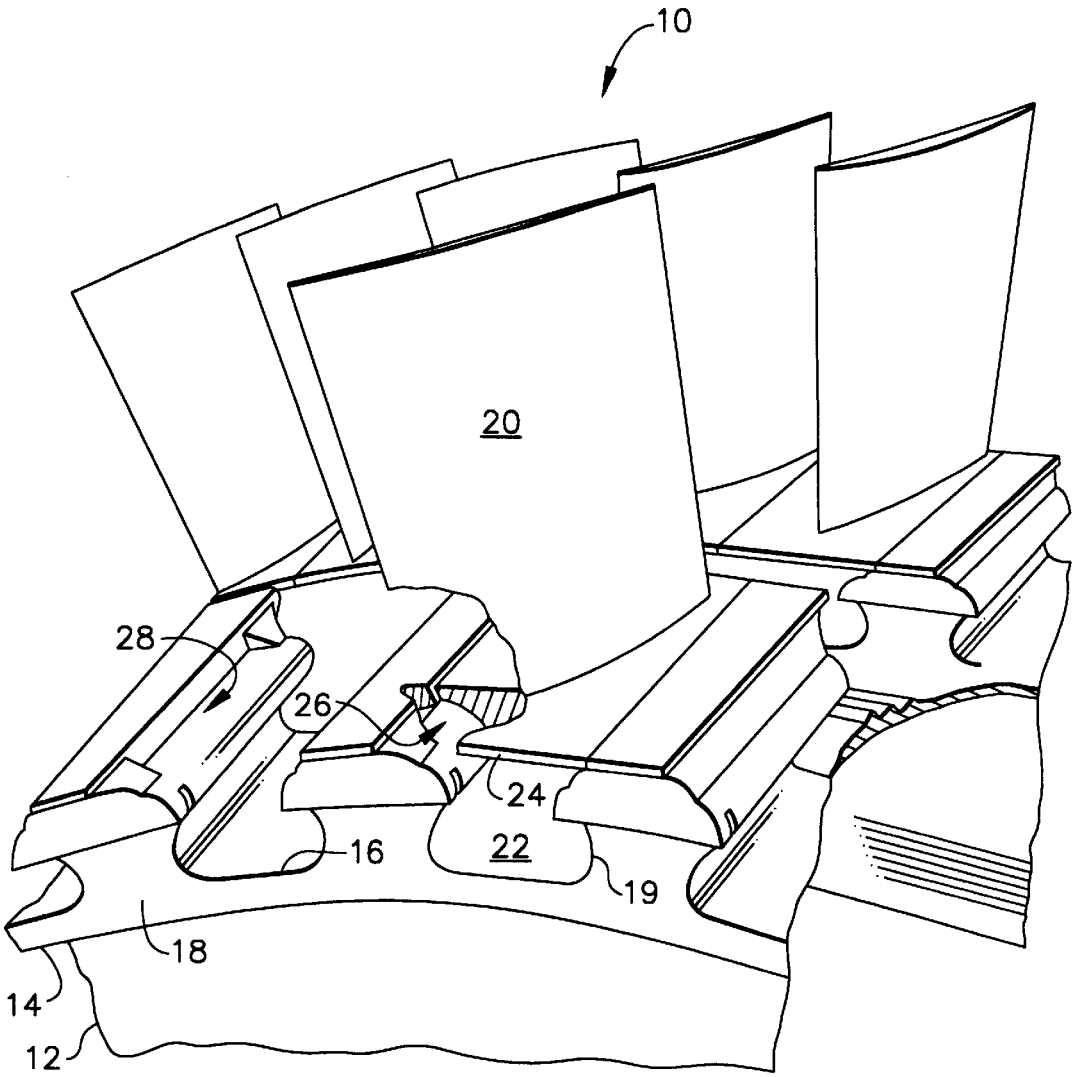
FIG. 1 is a perspective view partly in section of a portion of an aircraft gas turbine engine compressor rotor.

Referring to FIG. 1, a portion of a gas turbine engine rotor 10, typical of a section of the high pressure compressor, is shown having a disk 12 including a circumscribing rim 14 with a plurality of circumferentially disposed generally axially extending blade slots 16, in the form of dovetail slots, cut therethrough forming dovetail posts 18 therebetween. Blade slots 16 are often not cut exactly parallel to the engine axis or centerline but may be somewhat angled in the circumferential direction for dynamic and structural reasons. Such a direction is considered generally axially extending for the purpose of this patent application. Dovetail slot 16 receives compressor blade 19 having an airfoil 20 radially outward of a blade root 22, which conforms to and are designed to be received by dovetail slots 16, and a platform 24 therebetween. A damper chamber 26 is formed by a recess 28 in post 18 beneath platform 24. Rotor 10 is illustrated herein primarily to show a known rotor assembly and its basic components.

Figure 2:
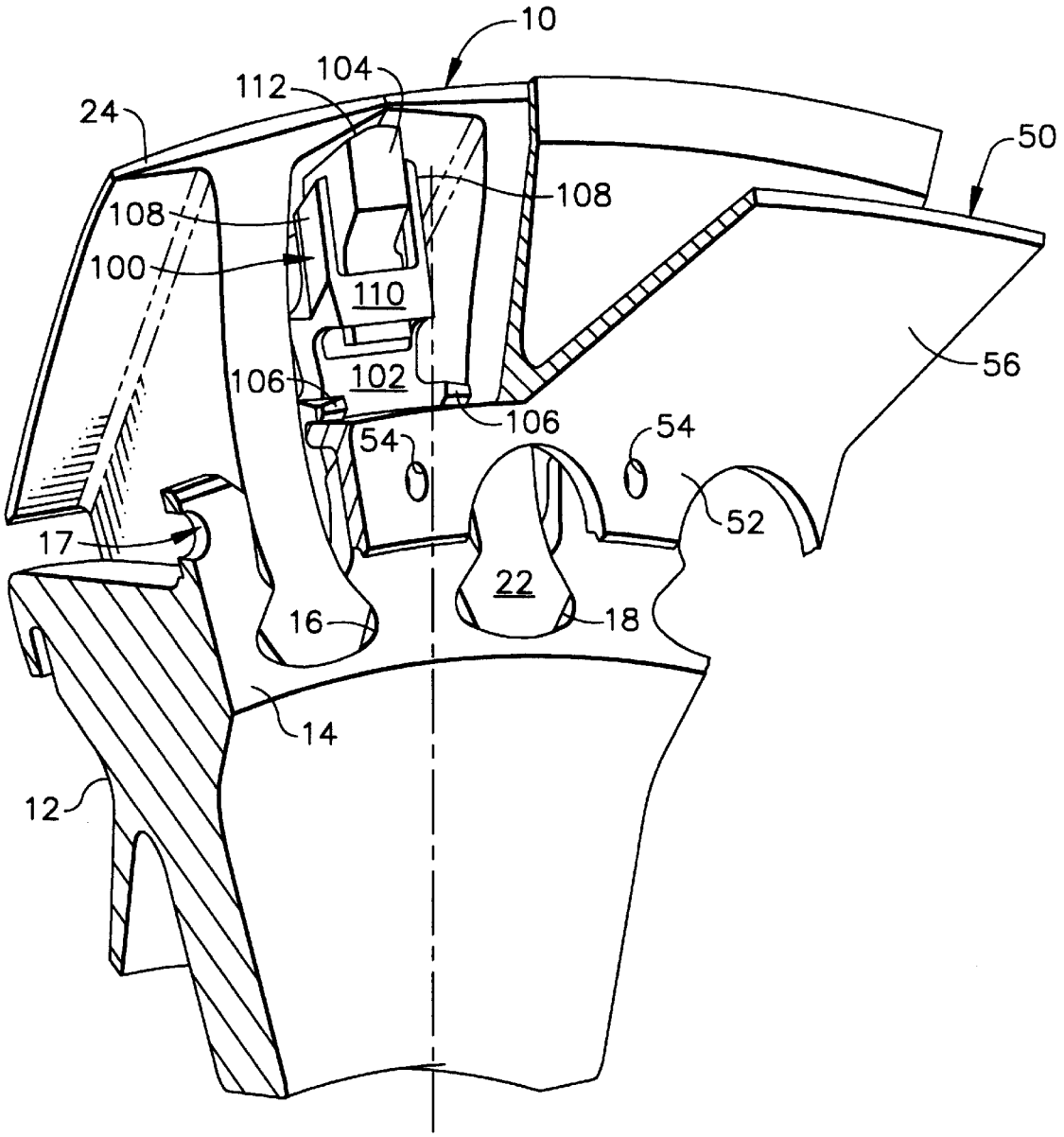
FIG. 2 is a perspective view of a portion of stage 1 and stage 2 rotors and a damper in accordance with one embodiment of the present invention.

FIG. 2 is a perspective view of a portion of stage one and stage two rotors 10 and 50, and a damper 100 in accordance with one embodiment of the present invention. Components of stage one rotor 10 in FIG. 2 which functionally correspond to components shown in FIG. 1 are referenced in FIG. 2 using the same reference numerals used in FIG. 1. Stage two rotor 50, which is illustrated with portions cut-away, include a flange 52 having a plurality of bolt openings 54. Flange 52 is cut to receive a locking arm of a bolt as described below in more detail. A forward arm 56 of stage two disk 50 also is shown in FIG. 2.

As shown in FIG. 2, damper 100 includes a retainer 102 and a chicklet 104. Retainer 102 is secured to rotor disks 14 and 12 by a bolt (not shown in FIG. 2) which extends through opening 54 in disk 12, an opening 17 in disk 14, and an opening (not shown in FIG. 2) in retainer 102. Retainer 102 includes support flanges 106 which facilitate positioning retainer 100 relative to disks 14 and 12, and sidewalls (or guides) 108 for positioning chicklet 104. A cross wall member 110 extends between guides 108 and limits rear, or axial movement of chicklet 104.

Specifically, chicklet 104 is movably positioned within retainer 102, and movement of chicklet 104 is limited by sidewalls 108 and cross wall member 110 of retainer 102. Retainer 102 positions chicklet 104 so that in operation, a contact surface 112 of chicklet 104 makes blade to blade contact with adjacent blades.

More specifically, in operation, centrifugal forces drive chicklet 104 into contact with the undersides of platforms 24. Since chicklet 104 is in contact with adjacent blades, blade to blade damping is provided by damper 100. Further, due to the geometric configuration of contact surface 112 of chicklet 104, as described hereinafter in more detail, chicklet 104 tends to travel upward along the underside of platforms 24. As chicklet 104 slides upward on platform 24, chicklet 104 contacts cross wall member 110 of retainer 102, and since retainer 102 is secured to disks 14 and 52, blade to ground damping is provided by damper 100.

As described above, both blade to blade and blade to ground damping is provided by damper 100, and such combination damping is believed to provide significantly greater damping than the damping provided by either blade to blade damping or blade to ground dampers. Further, since damper 100 provides both blade to blade and blade to ground damping, damper 100 can be used in a wider variety of applications than known dampers which provide only either blade to blade or blade to ground damping. That is, by providing multiple types of damping, rather than having to use multiple types of dampers for multiple applications, damper 100 can be used for multiple applications. Damper 100 therefore facilitates reducing inventory costs and simplifies fabrication.

Figure 3A:
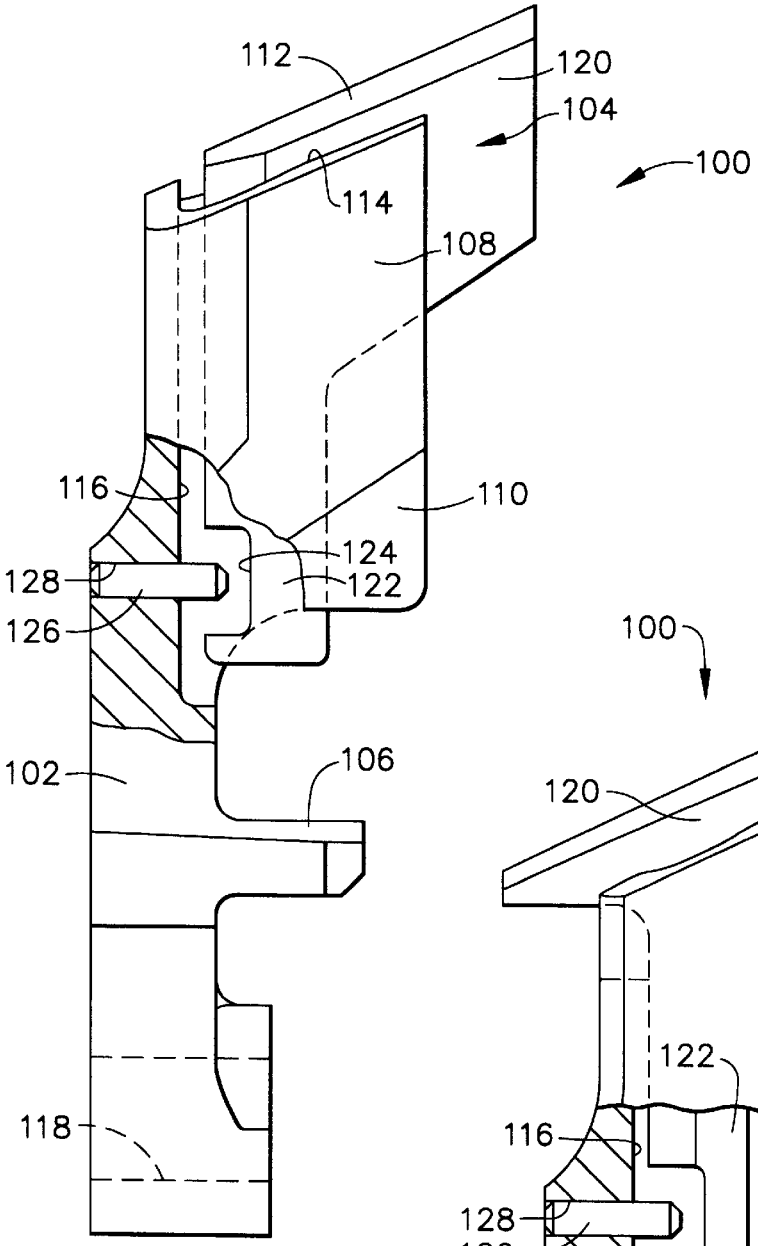
FIGS. 3A and 3B are partial cross-sectional perspective and side views, respectively, of the damper shown in FIG. 2.
Figure 3B:
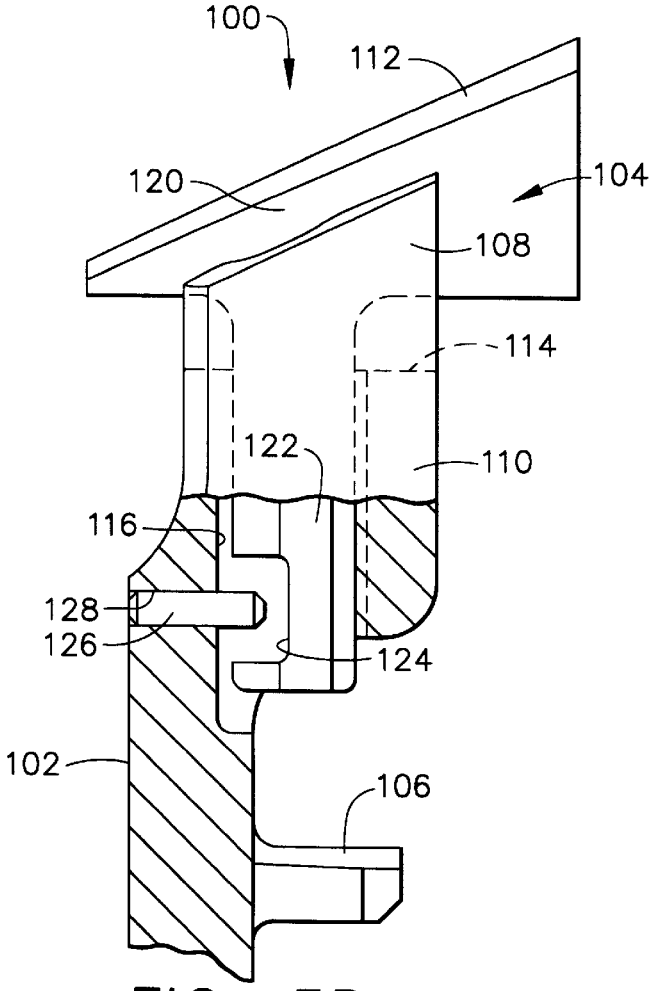

FIGS. 3A and 3B are partial cross-sectional perspective and side views, respectively, of damper 100 shown in FIG. 2. Referring to FIGS. 3A and 3B, retainer 102 includes support flanges 106 and guides 108. Guides 108 define a chicklet receiving channel 114, and a slot 116 extends through retainer 102 from channel 114. In addition, a bolt opening 118 is provided in retainer 102, and bolt opening 118 aligns with bolt opening 54 in disk 52 and opening 17 of disk 14 (FIG. 2), as described above.

Chicklet 104 has a substantially triangular shaped portion 120 and a shaft 122 extending from triangular shaped portion 120. Portion 120 is partially located, and trapped, within chicklet receiving channel 114 and includes contact surface 112 for contacting the undersides of platforms 24 (FIG. 2). Shaft 122 is partially located in slot 116 and includes a cutout 124. A pin 126 (e.g., fabricated from Torlon material) extends into an opening 128 in retainer 102 and is fixedly secured to retainer 102. Pin 126 also extends into slot 116 and into cutout 126 to limit movement of chicklet 104 relative to retainer 102 prior to installation.

Figure 4A:
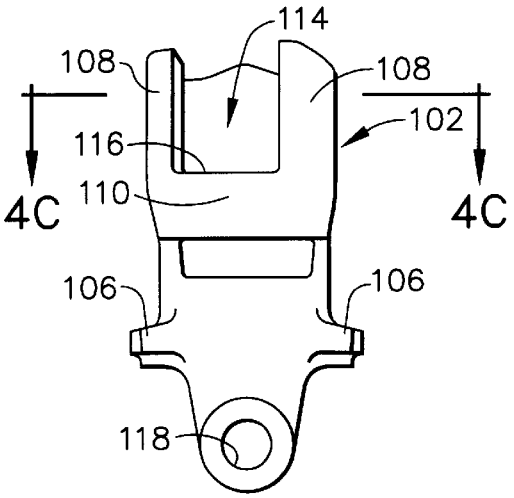
FIGS. 4A, 4B and 4C are rear, side, and top views of the retainer of the damper shown in FIGS. 3A and 3B.
Figure 4B:
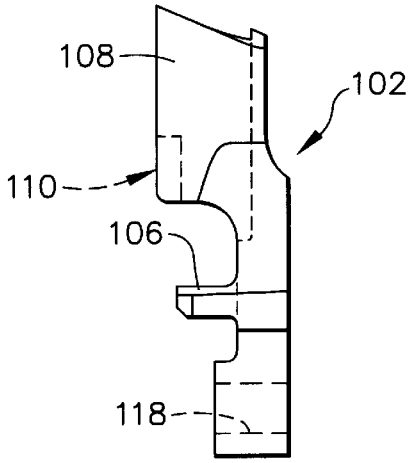
Figure 4C:
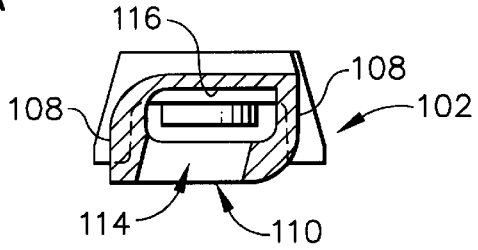

FIGS. 4A, 4B and 4C are rear, side, and top views of retainer 102, including support flanges 106 and guides 108. Retainer 102 also includes a cross wall member 110 which extends between guides 108 and limits rearward, or axial movement of chicklet 104 by contacting a chicklet surface 123 (FIGS. 5B and 5C). Retainer 102 may be fabricated, for example, from titanium (e.g., TI 64), to reduce the load of damper 100.

Figure 5A:
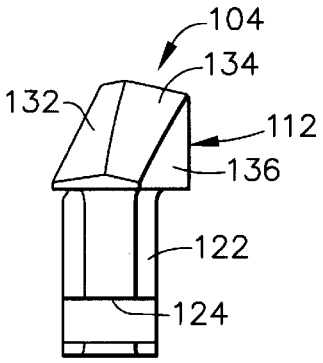
FIGS. 5A, 5B, and 5C are front side and rear views of the damper chicklet of the damper shown in FIGS. 3A and 3B.
Figure 5B:
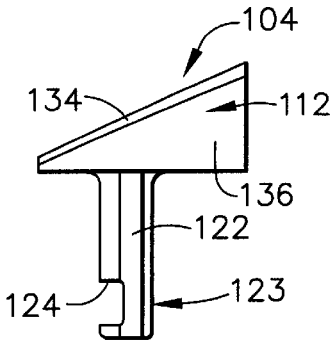
Figure 5C:
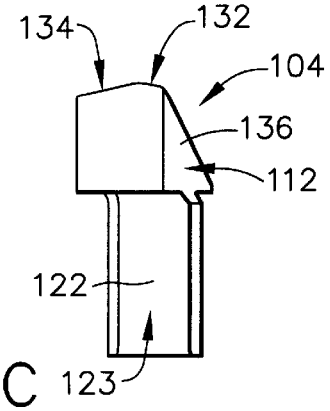

FIGS. 5A, 5B, and 5C are front, side and rear views of damper chicklet 104 of damper 100. As shown in FIGS. 5A, 5B and 5C, contact surface 112 of chicklet 104 includes a first portion 132, a second portion 134, and a third portion 136. The relative angular positioning of portions 132, 134 and 136 is selected so that when surface 112 via portions 132 and 134 contacts the underside of platforms 24 (FIG. 2), chicklet 104 tends to travel upward and rearward along the underside of platforms 24. Portions 136 are guided by guides 108. Chicklet 104 may be fabricated from aluminum and coated with a coating such as a copper-nickel-indium coating or a molydag (graphite) coating.

Figure 6:
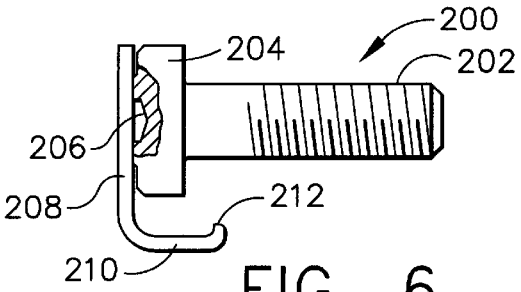
FIG. 6 is a side view of a self-wrenching bolt used to secure the damper shown in FIGS. 3A and 3B to a rotor.

FIG. 6 is a side view of a self-wrenching bolt 200, with a portion cut-away, used to secure damper 100 to disks 14 and 52. Bolt 200 includes a threaded shank 202 and a head 204 having an opening 206 used when fabricating shank 202. A locking cover 208 is secured, e.g., welded, to head 204. Cover 208 includes a locking arm 210 with a flange 212. Locking arm 210 is selected to have a length and resiliency so that when bolt 200 is inserted through aligned bolt openings in disks 14 and 52 and retainer 102, flange 212 snaps over an end of a component of rotor flange 52 and snugly maintains bolt 200 in position, including substantially preventing bolt 200 from rotational movement relative to retainer 102 within an otherwise blind cavity. With bolt 200 positioned as described above, a nut (e.g., a self-locking, ten point-increased wrenching, dry film nut) can be threadedly secured to bolt 200 on threaded shank 20 and thereby secures retainer 102 to disks 14 and 52.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. A damper for damping vibrations in blades of a turbine rotor including a disk and blade platforms, said damper comprising:

a retainer for attaching to the disk of the rotor blades, said retainer comprising a chicklet receiving channel; and a chicklet movable relative to said retainer and trapped within said chicklet receiving channel, said chicklet comprising a triangular shaped portion and a shaft extending from said triangular shaped portion, and a cutout in said shaft.

2. A damper in accordance with claim 1 wherein said retainer comprises first and second guides positioned on opposing sides of said chicklet and a cross wall member for limiting movement of said chicklet.

3. A damper in accordance with claim 1 further comprising a pin extending into an opening in, and fixed to, said retainer.

4. A damper in accordance with claim 1 wherein said retainer further comprises a support flange for cooperating with the disk to facilitate positioning of said damper.

5. A damper in accordance with claim 1 wherein a bolt opening is located in the disk, and said retainer further comprises a bolt opening for aligning with said disk bolt opening.

6. A damper in accordance with claim 5 further comprising a self-wrenching bolt for extending through said retainer bolt opening and the disk bolt opening to secure said damper to the disk.

7. A damper in accordance with claim 1 wherein said chicklet further comprises a contact surface for contacting an underside of adjacent blade platforms.

8. A damper in accordance with claim 1 further comprising a pin extending into an opening in, and fixed to, said retainer, said pin extending into said cutout.

9. A damper for damping vibrations in blades of a turbine rotor including a disk and blade platforms, said damper comprising a retainer and a chicklet cooperating to provide both blade to blade damping and blade to ground damping, said chicklet comprising a contact surface for contacting an underside of adjacent blade platforms, a triangular shaped portion and a shaft extending from said triangular shaped portion, and a cutout in said shaft.

10. A damper in accordance with claim 9 wherein said retainer attaches to the disk of the rotor blade, said retainer comprising a chicklet receiving channel, and said chicklet is trapped within said chicklet receiving channel.

11. A damper in accordance with claim 9 wherein said retainer comprises first and second guides positioned on opposing sides of said chicklet for limiting movement of said chicklet, and a support flange for cooperating with the disk to facilitate positioning of said damper.

12. A damper in accordance with claim 9 further comprising a cross wall member to limit movement of said chicklet relative to said retainer.

13. A damper in accordance with claim 9 further comprising a pin extending into an opening in, and fixed to, said retainer, said pin extending into said cutout.

* * * * *